United States Patent [19]

Kunze et al.

[11] Patent Number: 4,902,351

[45] Date of Patent: Feb. 20, 1990

[54] METHOD FOR DECONTAMINATING RADIOACTIVELY CONTAMINATED SURFACES OF METALLIC MATERIALS

[75] Inventors: Siegmar Kunze, Gernsbach; Gunter Losch, Leimersheim, both of Fed. Rep. of Germany

[73] Assignee: Kernforschungszentrum Karlsruhe GmbH, Fed. Rep. of Germany

[21] Appl. No.: 652,397

[22] Filed: Sep. 20, 1984

Related U.S. Application Data

[63] Continuation of Ser. No. 417,895, Sep. 14, 1982, abandoned.

[30] Foreign Application Priority Data

Nov. 2, 1981 [DE] Fed. Rep. of Germany ..... 31434401

[51] Int. Cl.[4] ..... C23G 1/02

[52] U.S. Cl. ..... 134/3; 134/31; 134/41; 252/626

[58] Field of Search ..... 134/3, 31, 41; 252/626

[56] References Cited

U.S. PATENT DOCUMENTS

| | | | |
|---|---|---|---|
| 1,373,573 | 4/1921 | Sorenson | 134/41 X |
| 3,598,741 | 8/1971 | Kanno | 134/41 X |
| 3,992,313 | 11/1976 | Anderson et al. | 134/41 X |
| 4,400,289 | 8/1983 | Geldner et al. | 134/41 X |

FOREIGN PATENT DOCUMENTS 2333516 5/1979 Fed. Rep. of Germany .

OTHER PUBLICATIONS

Moldenhawer, Kernenergie, "Kontamination und Dekontamination von Oberflächen", vol. 5, 1962, pp. 585–600.

*Primary Examiner*—Richard V. Fisher
*Attorney, Agent, or Firm*—Sughrue, Mion, Zinn, Macpeak & Seas

[57] ABSTRACT

The present invention relates to a method for decontaminating radioactively contaminated surfaces of metallic materials with the use of nitric acid and hydrofluoric acid. The surfaces to be decontaminated are subjected to a vapor mixture of water vapor, hydrogen fluoride and nitric acid vapor.

2 Claims, No Drawings

METHOD FOR DECONTAMINATING RADIOACTIVELY CONTAMINATED SURFACES OF METALLIC MATERIALS

This is a continuation of application Ser. No. 06/417,895 filed 09/14/82, now abandoned.

BACKGROUND OF THE INVENTION

The present invention relates to a method for decontaminating radioactively contaminated surfaces of metallic materials with the use of nitric acid and hydrofluoric acid.

In a summarizing report entitled "Kontamination und Dekontamination von Oberflachen," in translation, "Contamination and Decontamination of Surfaces", in *Kernenergie,* in translation, *Nuclear Energy,* Vol. 5, 1962, pages 585–600, H. F. Moldenhawer describes a number of different decontamination methods and a number of decontamination agents. The large majority of the listed decontamination agents are used in the form of aqueous solutions. Moldenhawer points out that strong inorganic acids belong to the most effective, but also the most aggressive, decontamination agents. Nitric acid or $HNO_3$ containing solutions are listed in first place. Moldenhawer states, however, that it is error to draw the conclusion that pure nitric acid would be the best decontamination agent. For example, Moldenhawer mentions, among others, a solution of 3% HF+20% $HNO_3$, referred to as a 3–20 reagent, as a decontamination agent for stainless steel. For other surfaces, completely different solutions are used.

German Patent No. 23 33 516 discloses a vapor phase method for decontaminating radioactively contaminated metallic surfaces wherein the surfaces are brought into contact with vapor containing substances which reduce surface tension. This method employs a decontamination agent in the form of a vapor phase mixture of water vapor, nitric acid vapors and water vapor volatile, perfluorated, aliphatic acids and/or salts of these acids, and the like. The vapor phase mixture has a nitric acid concentration below that of the azeotropic mixture and a perfluoro carboxylic acid content in the vapor phase corresponding to that which reduces surface tension in the condensate at 293.16° K. to an order of magnitude of 250 $\mu$N/cm. The concentration of nitric acid in the vapor phase preferably corresponds to a concentration in the range between 2 and 6 mol/l $HNO_3$, measured in the condensate, and the content of perfluoro carboxylic acid and/or its salts in the vapor phase corresponds to a concentration in the range between 100 and 300 ppm. In this method, a mother solution is heated to the boiling point to form the decontamination agent, the boiling temperature is maintained until the decontamination process is completed, and care is taken to avoid contact of the mother solution with the surfaces or articles.

The known decontamination methods, as they are practiced in processing systems, pipelines, tanks, boilers, heat exchangers, and the like, sometimes produce only a low decontamination effect. The amounts of waste in the form of spent decontamination agents are sometimes relatively large, particularly for decontamination by way of immersion in a bath. Moreover, the decontamination agent wastes are sometimes poorly compatible with customary fixing methods for radioactive liquid wastes.

SUMMARY OF THE PRESENT INVENTION

It is an object of the present invention to provide a method for the decontamination of radioactively contaminated surfaces of metallic materials which method produces at least the same decontamination effect as the method disclosed in German Patent No. 23 33 516, but employs a decontamination agent whose components are, in part, more easily obtainable or available and less expensive.

Another object of the present invention is to provide such a method in which the decontamination agent, after use, requires less effort in the subsequently required solidification and elimination of wastes charged with the radioactive substances.

A further object of the present invention is to provide such a method which employs decontamination agents which lead to a noticeable reduction in waste volume and exhibit better compatibility with customary fixing methods and fixing agents for radioactive liquid wastes.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a method for decontaminating radioactively contaminated surfaces of metallic materials with the use of nitric acid and hydrofluoric acid comprising subjecting the surfaces to be contaminated to a vapor mixture of water vapor, hydrogen fluoride vapor and nitric acid vapor.

It is to be understood that both the foregoing general description and the following detailed description are exemplary, but are not restrictive of the invention.

DETAILED DESCRIPTION OF THE INVENTION

Advantageously, the concentration of hydrogen fluoride vapor in the vapor mixture corresponds to a concentration in the range between 0.1 mol/ and 1.0 mol/ as measured in a condensate formed by condensing the vapor mixture. The desired decontamination effect preferably is achieved by producing a concentration of nitric acid vapor in the vapor mixture which correspond to a concentration in the range between 0.05 mol/ and 0.5 mol/ as measured in the condensate.

The ratio of hydrogen fluoride vapor concentration to nitric acid vapor concentration in the vapor phase preferably corresponds to a ratio of $\geqq 1$ in the condensate, as measured by the number of moles HF/ to number of moles $HNO_3$/l. It has been found to be particularly advantageous to have concentration ratios in the vapor phase which were obtained from a boiling mother solution, having a concentration ratio of number of moles HF/ to number of moles $HNO_3$/l in the range from 2:1 to 4:1 as measured in a water containing condensate formed by condensing the vapor phase. The relatively small quantities of HF and $HNO_3$ can also be added directly to the water vapor in measured quantities.

For decontamination, the metallic workpieces are introduced into the vapor chamber of a closed system, the mother solution of diluted nitric acid and hydrofluoric acid is heated to the boiling point, and the vaporous decontamination agent is evaporated therefrom and recondensed until the radioactive contamination has been almost completely removed from the workpiece surfaces. Contact of the acid vapor decontamination agent with the surfaces to be cleansed preferably occurs at approximately 100° C. or somewhat lower. The contamination on the surfaces is then removed uniformly and pitting or intercrystalline corrosion is avoided.

An advantage of decontamination in the vapor phase is that even difficultly accessible places of the articles to be cleansed are more easily accessible for vapors than for liquids. This makes the decontamination process of the present invention more independent of the shapes of the goods to be cleansed. Moreover, the goods to be decontaminated come into contact only with the clean decontamination agent whose effectiveness has not been reduced.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

High grade steel samples of 1.4541 steel were maintained, for the purpose of contamination, for 500 hours in the liquid phase of a contamination solution which had been heated to 300° C. in a 1 liter high pressure autoclave, corresponding to a vapor pressure of 88 bar. The contamination solution comprised a nitric acid solution of Co-60 having an activity of about 15μCi/ml. Thereafter, the high grade steel samples were rinsed for 10 minutes in distilled water at room temperature, dried and measured for radioactivity.

Then, the samples were treated for 1 to 6 hours in a vapor chamber with a vapor phase decontamination agent obtained from a boiling mother solution containing 0.4 mol hydrofluoric acid per liter and 0.1 mol nitric acid per liter, as measured in the water containing condensate formed by condensing the decontamination agent.

The residual activities measured thereafter were 30.8% of the original activity after one hour, 10.7% after two hours, 0.8% after three hours, 0.05% after four hours and <0.01% after 6 hours.

EXAMPLE 2

Pieces of pipe of the material 1.4550 from the condensate discharge pipes of the steam converter of the nuclear power plant KKW at Lingen, contained contamination as the result of its use in the nuclear plant and which, due to a longer period of intermediate storage, contained practically only Co-60. Immediately before decontamination, a radiation dosage of 50 mrem was measured on the outside of the pipe and a dosage of 250 mrem inside the pipe. The pieces of pipe were decontaminated in the vapor chamber with a decontamination agent as described in Example 1.

The residual activities measured after the treatment were 45.2% of the original activity after one hour, 8.7% after two hours, 0.3% after three hours and <0.01% after four hours.

EXAMPLE 3

High grade steel samples of 1.4541 steel were contaminated as described in Example 1.

Then, the samples were treated for 1 to 6 hours in the steam chamber with a decontamination agent obtained from a boiling mother solution containing 0.13 mol hydrofluoric acid per liter and 0.06 mol nitric acid per liter, as measured in the water containing condensate formed by condensing the decontamination agent.

The residual activities measured after the treatment were 28.5% of the original activity after one hour, 12.0% after two hours, 3.6% after three hours, 1.4% after four hours and 0.3% after six hours.

EXAMPLE 4

Pieces of pipe of the material 1.4550, as described in Example 2, contaminated due to use in a nuclear power plant, were decontaminated as described in Example 3 with the decontamination agent employed in Example 3.

The residual activities measured after the treatment were 74.6% of the original activity after one hour, 51.0% after two hours, 26.4% after three hours, 0.5% after four hours and 0.1% after six hours.

EXAMPLE 5

High grade steel samples of 1.4541 steel were contaminated as described in Example 1.

Then, the samples were treated for one to eight hours in a vapor chamber with a decontamination agent obtained from a boiling mother solution containing 0.20 mol hydrofluoric acid per liter and 0.34 mol nitric acid per liter, as measured in the water containing condensate, thus providing a molar concentration ratio of hydrogen fluoride vapor to nitric acid vapor of 1:1.7.

The residual activities measured after the treatment were 61.5% of the original activity after one hour, 34.3% after two hours, 20.4% after three hours, 10.9% after four hours and 1.8% after eight hours.

The lower decontamination efficiency of this Example is the result of a shift in the concentration ratios, as measured by the number of moles/1 HF to number of moles/1 $HNO_3$, toward <1.

It will be understood that the above description of the present invention is susceptible to various modifications, changes and adaptations, and the same are intended to be comprehended within the meaning and range of equivalents of the appended claims.

What is claimed is:

1. Method for decontaminating radioactively contaminated surfaces of metallic materials with the use of nitric acid and hydrofluoric acid, comprising subjecting for at least four hours the surfaces to be decontaminated to a vapor mixture of water vapor, hydrogen fluoride vapor and nitric acid vapor, with the ratio of hydrogen fluoride vapor concentration to nitric acid vapor concentration in the vapor phase corresponding to a ratio of 2:1 to 4:1, as measured by the number of moles HF/1 to number of moles $HNO_3$/l in a condensate formed by condensing the vapor mixture, and wherein the concentration of hydrogen fluoride vapor in the vapor mixture corresponds to a concentration in the range between 0.1 mol/l and 1.0 mol/l, as measured in a condensate formed by condensing the vapor mixture, and the concentration of nitric acid vapor in the vapor mixture corresponds to a concentration in the range between 0.05 mol/l and 0.5 mol/l measured in a condensate formed by condensing the vapor mixture.

2. Method according to claim 1, wherein the surfaces are subjected to the vapor mixture for about six hours.

* * * * *